US006978731B2

(12) United States Patent
Erbetta

(10) Patent No.: US 6,978,731 B2
(45) Date of Patent: Dec. 27, 2005

(54) TUBULAR STRUCTURE ARRANGEMENT

(76) Inventor: Robert A. Erbetta, P.O. Box 44, Marblehead, MA (US) 01945

( * ) Notice: Subject to any disclaimer, the term of this patent is extended or adjusted under 35 U.S.C. 154(b) by 0 days.

(21) Appl. No.: 10/706,220

(22) Filed: Nov. 12, 2003

(65) Prior Publication Data

US 2004/0194410 A1 Oct. 7, 2004

Related U.S. Application Data

(63) Continuation-in-part of application No. 10/171,813, filed on Jun. 14, 2002.

(51) Int. Cl.[7] ..... B63B 17/00

(52) U.S. Cl. ..... 114/361; 114/364

(58) Field of Search ..... 114/361, 364; 135/88.01, 88.13, 121, 161; 403/233, 234, 403/235, 237

(56) References Cited

U.S. PATENT DOCUMENTS 4,007,993 A * 2/1977 Schwartz ..... 403/3
4,352,255 A * 10/1982 Warehime ..... 446/120
4,529,331 A * 7/1985 Schwartz ..... 403/73
6,260,505 B1 * 7/2001 Polidan ..... 114/361
6,672,241 B2 * 1/2004 Warfel et al. ..... 114/361

FOREIGN PATENT DOCUMENTS

DE 19540473 A * 4/1997

* cited by examiner

*Primary Examiner*—Sherman Basinger
(74) *Attorney, Agent, or Firm*—Don Halgren

(57) ABSTRACT

A customizable frame assembly for providing a housing structure for attachment to a boat rail arrangement on the gunnel of a boat. The assembly is utilized for supporting a covering of the boat. The assembly comprises an arrangement of hollow elongated members connected by a plurality of articulable joints. The arrangement includes a first hollow elongated member and a second hollow elongated member, each having a first end with a boat rail arrangement engaging portion thereon.

8 Claims, 4 Drawing Sheets

TUBULAR STRUCTURE ARRANGEMENT

BACKGROUND OF THE INVENTION

1. Field of the Invention

This invention relates to tubular frame members and more particularly to a multi-component assembly for the manufacture of a customized structure suited particularly for covering boats, and is a continuation in part application of co-pending U.S. application Ser. No. 10/171,813 filed on Jun. 14, 2002 incorporated herein by reference in its entirety.

2. Prior Art

Frame assemblies are necessary particularly for boat owners, when that end of the season chore comes along and it is time to cover one's boat. It is a troublesome task, often done by setting up a wood frame or some tubular frame which are both difficult to accommodate various features of boat construction. Once these frame assemblies are completed, they are typically covered with some sort of a plastic tarp or the like to enclose the topside of a boat. Boats, particularly sailboats would have a combination of side rails, stanchions and safety lines running the length of the boat.

It is an object of the present invention to provide a framed structure which is easily assembled and adapted to almost any boat feature to permit that frame assembly to be completed in the simplest possible manner.

It is a further object of the present invention to provide a frame assembly which is light in weight, compact, long lasting, resistant to weather and corrosion and which is readily coverable by a variety of fabric or planar material.

It is still yet a further object of the present invention to overcome the disadvantages of the prior art.

BRIEF SUMMARY OF THE INVENTION

The present invention comprises a versatile, easy to assemble, readily customizable component arrangement of a frame assembly, which assembly may be utilized as a temporary structure covered by an external panel or fabric, particularly for a boat.

The frame assembly of the present invention will be shown adapted for construction and assembly of a frame for a boat, while it is also adaptable for other building structure purposes. That frame assembly includes an, elongated rail claw having a first end which is pressed onto engaging contact about a rigid bow rail and a stern rail (bow and stern pulpits) on the of a boat. The bow rail is typically constructed of stainless steel and is supported by welded tubular members secured to the gunnel on the bow of the boat. The elongated rail claw is hollow and receives a tubular inner mating member adjustably received therewithin. The tubular mating member may be attached to a further tubular member which passes into a knuckle joint as identified in the aforementioned '813 patent application. A further upper tubular member extends from the first knuckle joint rearwardly to a second knuckle joint extending longitudinally down the middle of the boat hull and spaced above its deck. The first and subsequent knuckle joints have a plurality of tubular members extending downwardly therefrom at a spaced-apart angle. Each tubular member has a lower end which mates with the upper end of a further elongated rail claw. The lower end of the further elongated rail claw is engaged about a portion of the bow rail at the bow of the boat.

The second knuckle joint is mated with a tubular member having a lower end which is mated to a side knuckle joint. The side knuckle joint has a connector housing which fits over the upper end of an elongated split enclosure. The elongated split enclosure is a cylindrically shaped member having a first end with a cylindrically shaped housing thereon, and a second end defined by a pair of split apart first and second legs. A generally parallel gap is arranged within the elongated split enclosure the gap having a gap first end. Utilization of the elongated split enclosure comprises the mating of the upper end of a stanchion attached adjacent the gunnel on a flanged base on the boat deck. The elongated split enclosure, looking something like a "wooden clothespin", mates over the upper end of that stanchion the gap permitting passage of a side cable therethrough. Those side cables extend around the periphery of the boat, between adjacent stanchions. The side cable is thus captured in a large first end gap at the inner end of the gap between the first and second legs of the elongated split enclosure.

The second end of the elongated split enclosure has a tapered wedged shape opening at its distalmost end to permit fast and simple assembly of the elongated split enclosure onto the upper end of each respective stanchion on the deck of the boat.

The hollow elongated rail claw has a first end and a second end. The second end comprises a generally cylindrically shaped body, and the first end comprises a formed skirt extending in a curvilinear fashion so as to fold down and over the longitudinal axis of the elongated rail claw. The skirt is attached to the cylindrical body of the rail claw by a somewhat resilient, narrowed pinched-waist portion arranged between the skirt and the cylindrical portion at its second end. A lower jaw portion has an apex on each side thereof which is radially close to the longitudinal axis of the elongated rail claw then is the distalmost end of the skirt. A gap is arranged between the lip on the distalmost end of the skirt and the pair of apexes to permit a rigid rail to be inserted and captured therein into that central opening proximal of the apex and skirt portions at that second end. Thus a rigid bow rail or a cable may be inserted into that central opening and enclosed therewith sufficient to support a frame assembly and to support a tarp or covering thereover during a storage season of the boat.

Thus what has been shown is a unique arrangement of components for simple and rapid attachment to a set of existing members typically found on a boat, which components permit adjustable fabrication of a frame assembly which may be customized to any size boat or similar structure. The components are adaptable and slidable relative to one another to permit secure properly sized construction of those components in a repeatable and reusable manner and adaptable to unique features of any particular boat. Those components, typically made of plastic or the like are also therefore weatherproof and lightweight.

The invention thus comprises a customizable frame assembly for providing a housing structure for attachment to a boat rail arrangement on the gunnel of a boat. The assembly may be utilized for supporting a covering of the boat. The assembly comprises an arrangement of hollow elongated members connected by a plurality of articulable joints, the arrangement including a first hollow elongated member and a second hollow elongated member, each member having a first end with a boat rail arrangement engaging portion thereon. The boat rail engaging portion of the first hollow elongated member comprises a resilient curved skirt flared over at least a portion of the first end of first hollow elongated member. The boat rail engaging portion of the second elongated hollow member comprises a pair of elongated, spaced-apart leg portions having an elongated gap therebetween. The spaced-apart leg portions are preferably generally identical to one another.

The curved skirt portion of the first member has a narrowed pinched portion connecting the skirt portion to the first hollow elongated member. The first member includes a lower jaw portion arranged circumferentially opposed to the skirt portion, the lower jaw portion and the narrow pinched portion of the elongated member defining a boat rail arrangement engaging opening, the opening extending transverse to a longitudinal axis of the hollow elongated member. The lower jaw portion of the first member has a distal edge with a pair of formed apexes thereon to facilitate the engagement of first elongated hollow member onto a boat rail arrangement. The skirt has a distalmost lip which extends across said longitudinal axis of the first elongated member. The elongated gap of the second elongated member has a tapered distal edge on each of its spaced-apart leg portions to facilitate attachment of the second hollow, elongated member to a cable on the boat rail arrangement.

The invention may also include a customizable frame assembly for providing a housing structure for attachment to a boat rail arrangement on the gunnel of a boat. The assembly may be utilized for supporting a covering of the boat. The assembly may comprise an arrangement of hollow elongated members connected by a plurality of articulable joints. The arrangement may including a plurality of rail attachment members, each having a first end with a boat rail arrangement engaging portion thereon, wherein the boat rail engaging portion of a first hollow elongated member comprises a resilient curved skirt flared over at least a portion of the first end of first hollow elongated member, and wherein the boat rail engaging portion of the first hollow elongated member may comprise a resilient curved skirt flared over at least a portion of the first end of first hollow elongated member.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
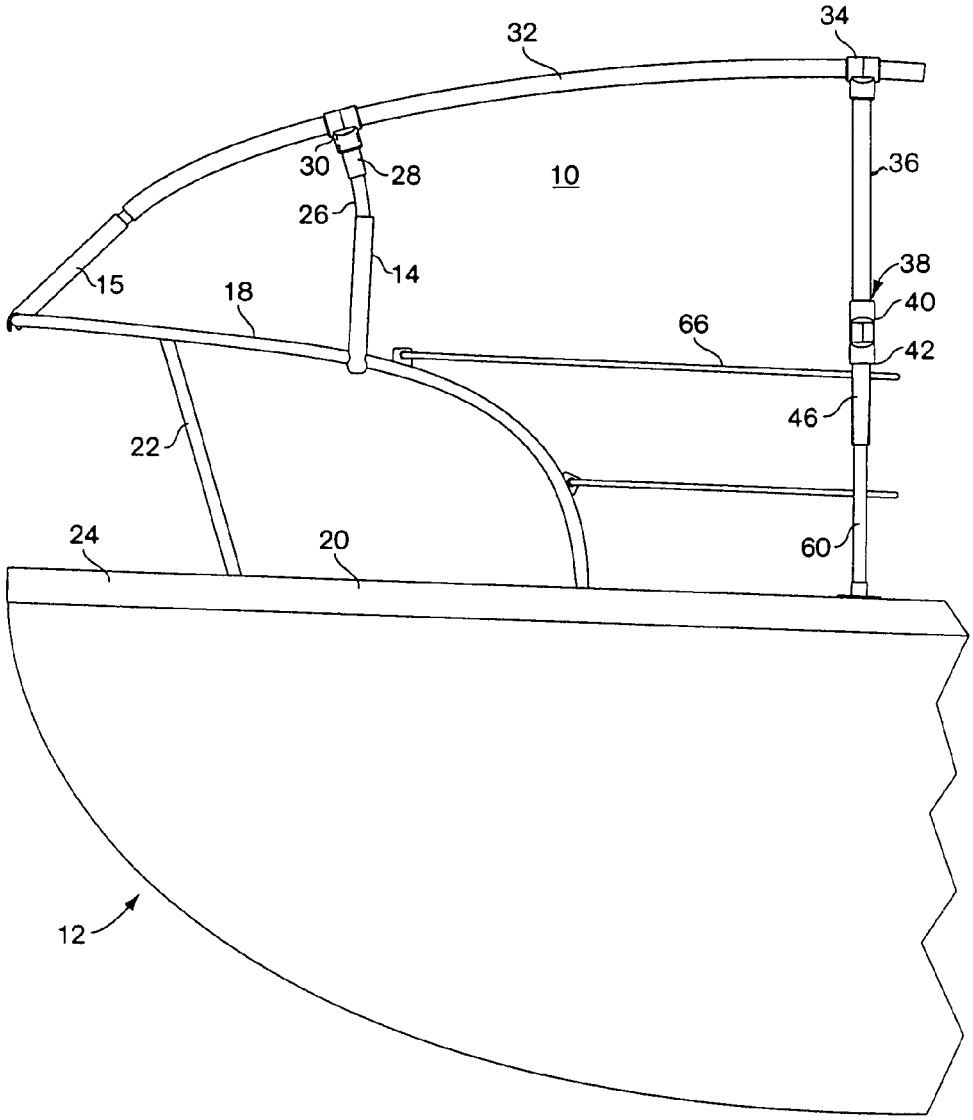
FIG. 1 is a side elevational view of the bow portion of a boat showing the portion of the frame assembly of the present invention attached thereto.

Referring now to the drawings in general, and particularly to FIG. 1, there is shown a portion of the present invention which comprises a versatile, easy to assemble, readily customizable component arrangement of a frame assembly 10, which frame assembly 10 may be utilized as a temporary structure covered by an external panel or fabric, particularly for a boat 12.

The frame assembly 10 of the present invention will be shown adapted for construction and assembly of a frame for the boat 12, while it is also adaptable for other building structure purposes within the scope of the invention. That frame assembly 10 shown in FIG. 1 includes an elongated rail claw 14 having a first end 16 which is pressed onto engaging contact about for example, a rigid bow rail (pulpit) 18 on the bow 20 of the boat 12. The bow rail 18 is typically constructed of stainless steel and is supported by welded tubular members 22 secured to the gunnel 24 on the bow 20 of the boat 12.

Figure 2:
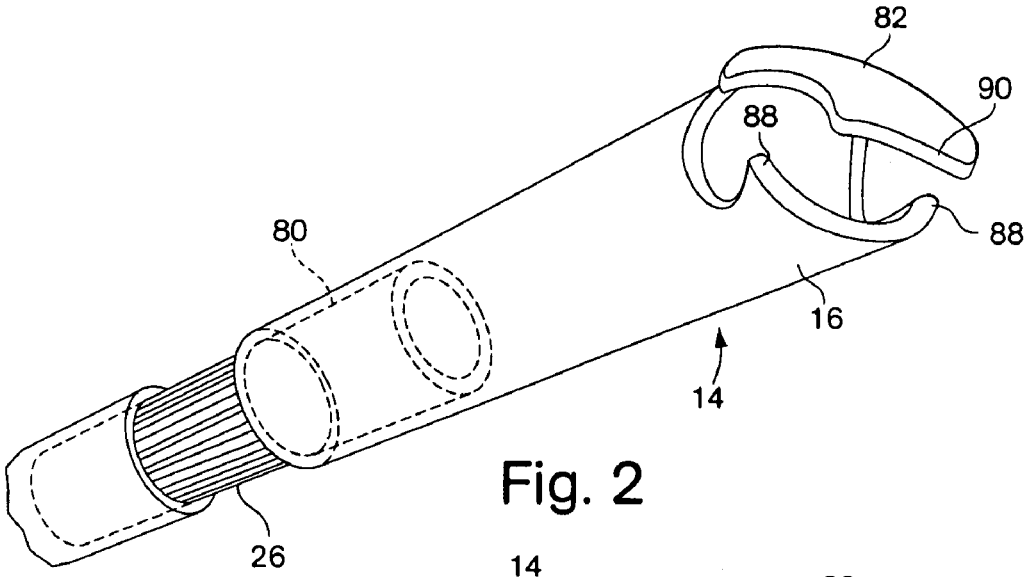
FIG. 2 is a perspective view of an elongated rail claw component of the present invention in conjunction with several mating tubular members thereattached.
Figure 6:
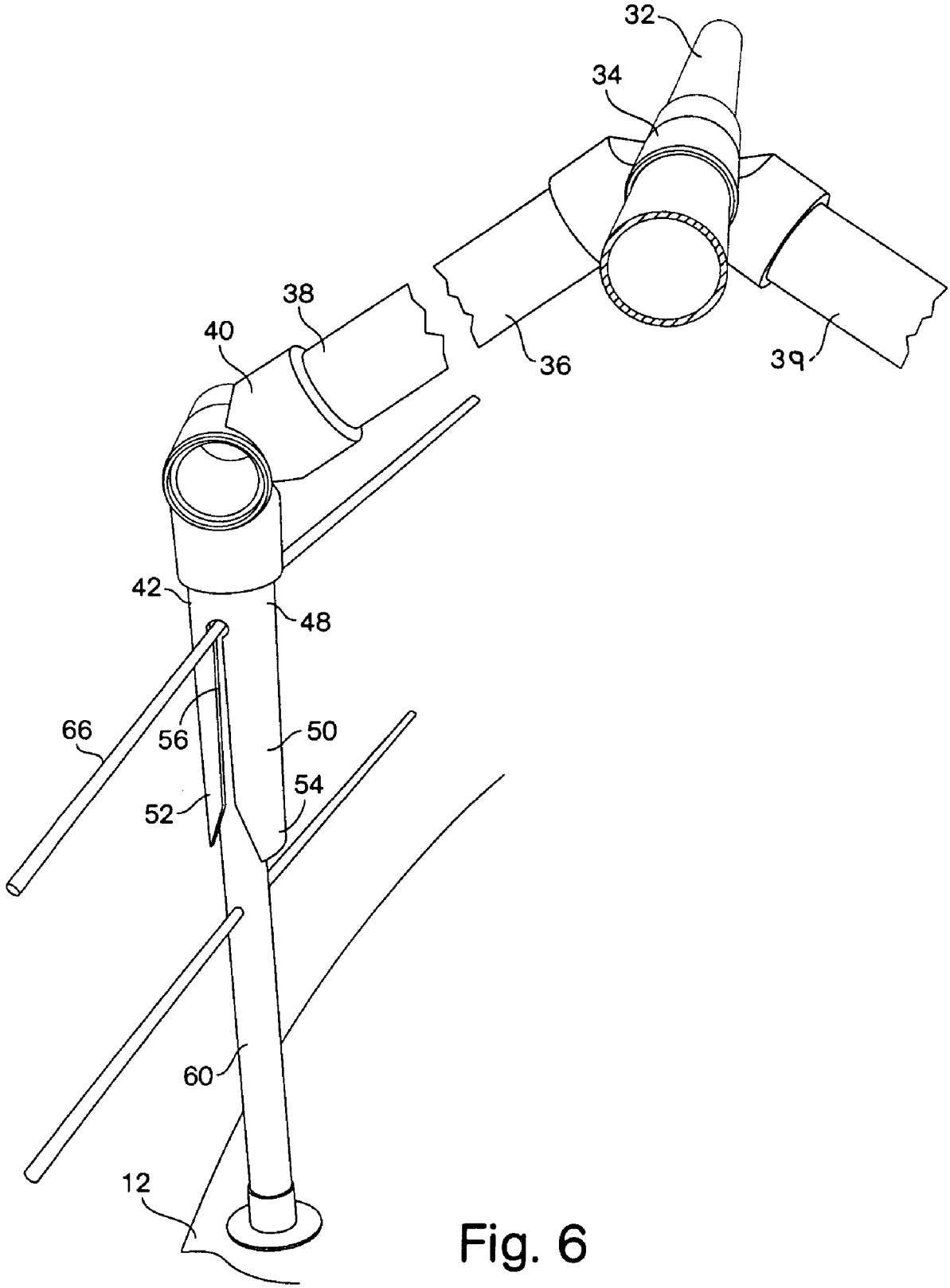
FIG. 6 is a perspective view of the elongated split extrusion component of the present invention shown assembled on a stanchion end in conjunction with other tubular components of the frame assembly.

The elongated rail claw 14 is hollow and receives a tubular inner mating member 26 adjustably received therewithin, as best seen in FIG. 2. The tubular mating member 26 may itself be attached to a further tubular member 28 which passes into a knuckle joint 30, as identified in the aforementioned '813 patent application, and as represented in FIG. 1. A further upper tubular member 32 (functioning as a ridge pole) extends from the first knuckle joint 30 rearwardly (aft) to a second knuckle joint 34 extending longitudinally down the middle of the boat hull and spaced above its deck, as represented in FIG. 1. The first, second and subsequent knuckle joints 30, 34 et seq. each (only the second joint 34, shown as an example, is represented in FIG. 6) have a plurality of tubular members 28/26 and 36 and 39 extending downwardly therefrom at a spaced-apart angle. Each tubular member (36 for example, as shown in FIG. 6) has a lower end 38 which mates with another knuckle joint 40 attached to the upper end 42 of an elongated split enclosure member 46. The lower end of the elongated rail claws 14 and 15, as opposed to the elongated split enclosure member(s) 46, are shown both engaged preferably only about a portion of the bow rail 18 at the bow 20 of the boat 12, as represented in FIG. 1.

Figure 7:
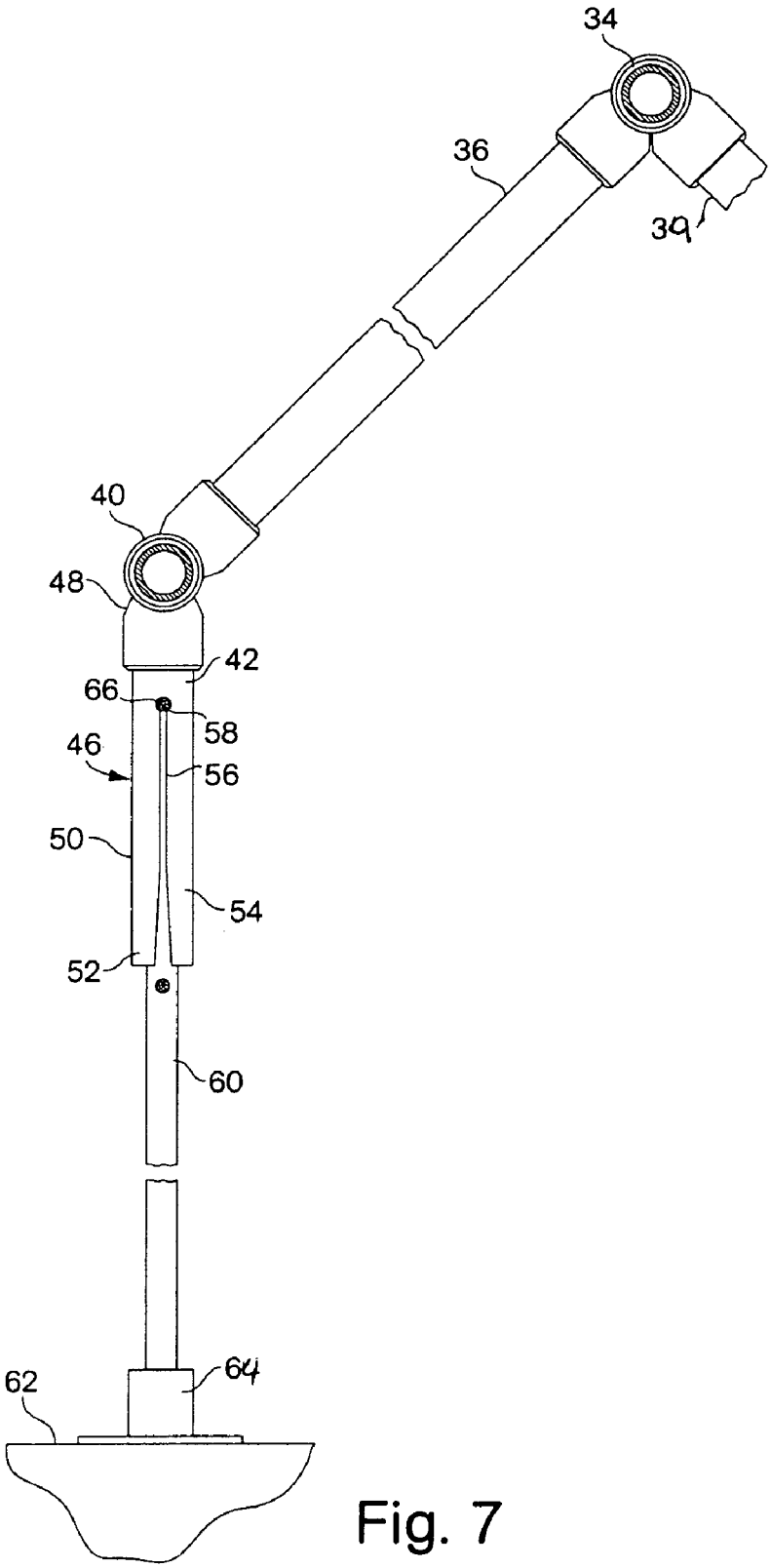
FIG. 7 is a side elevational view of the elongated split enclosure shown in FIG. 6.

The second knuckle joint 34, as shown in FIGS. 1 and 6, is mated with the tubular member 36 having its lower end 38 mated to the side knuckle joint 40. The side knuckle joint 40 has its connector housing fitting over the upper end 42 of the elongated split enclosure member 46. The elongated split enclosure member 46, represented best in FIGS. 6 and 7, is a cylindrically shaped member having a first or upper end 42 with a cylindrically shaped housing 48 thereon, and a split second end 50 defined by a pair of split-apart first and second legs 52 and 54. A generally parallel gap 56 is arranged within the elongated split enclosure member 46, the gap 56 having a gap first end 58. Utilization of the elongated split enclosure member 46 comprises the mating of the upper end of a stanchion 60 attached adjacent the gunnel 62 on a flanged base 64 on the boat deck. The elongated split enclosure member 46, looking somewhat like a "wooden clothespin", mates over the upper end of that stanchion 60, as represented in FIG. 7, the gap 56 permitting passage of a side cable 66 therethrough, as may be seen in FIG. 6. Those side cables 66 extend around the periphery of the boat 12, between adjacent stanchions 60. The side cable 66 is thus captured in the large first end gap 58 at the inner end of the gap 56 between the first and second legs 52 and 54 of the elongated split enclosure member 46, as is represented in FIGS. 1 and 6.

The second end 50 of the elongated split enclosure member 46 has a tapered wedged shape opening 70 at its lower split end 50 to permit fast and simple assembly of the elongated split enclosure member 46 onto the upper end of each respective stanchion 60 on the deck of the boat 12.

Figure 3:
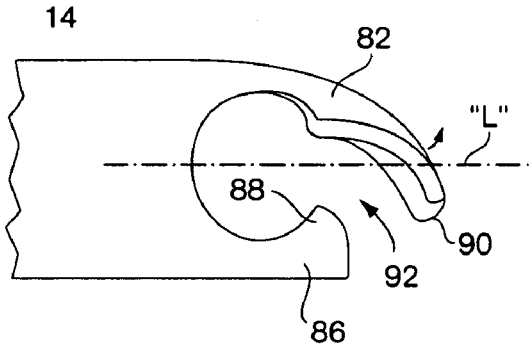
FIG. 3 is a side elevational view of a first end of the elongated rail claw disclosed in FIG. 2.
Figure 4:
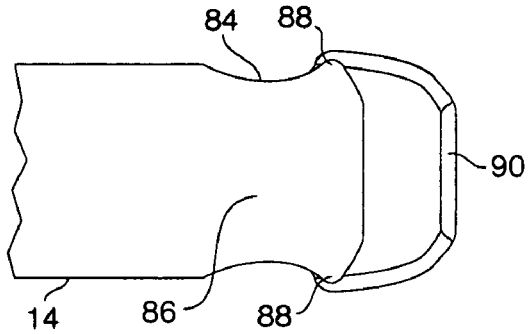
FIG. 4 is a bottom view of the first end of the rail claw shown in FIG. 3.
Figure 5:
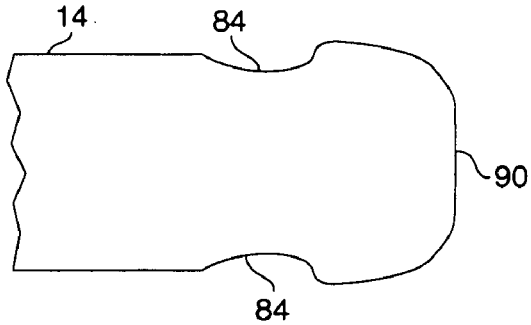
FIG. 5 is a plan view of the first end of the elongated rail claw shown in FIG. 2.

Returning now to the hollow elongated rail claw 14, shown more closely in FIGS. 2, 3 4 and 5, the rail claw 14 has its first end 16 and a second end 80. The second end 80 comprises a generally cylindrically shaped body, and the first end 16 comprises a formed skirt 82 extending in a curvilinear fashion as shown in FIGS. 2 and 3 so as to fold down and over the longitudinal axis "L" of the elongated rail claw. The skirt 82 is attached to the cylindrical body of the rail claw by a somewhat resilient, narrowed pinched-waist portion 84, as shown in FIG. 5, arranged between the skirt 82 and the cylindrical portion at its first end 16. A lower jaw portion 86 has an apex 88 on each side thereof which is radially close to the longitudinal axis "L" of the elongated rail claw than is the distalmost end lip 90 of the skirt 82. A gap 92 is arranged between the lip 90 on the distalmost end of the skirt 82 and the pair of apexes 88 to permit a rigid rail 18 to be inserted and captured therein, as represented in FIG. 1, into that central opening proximal of the apexes 88 and skirt portions 82 at that first end 16. Thus a rigid bow rail 16 or a cable 66 may be inserted into that narrow central opening 92 and enclosed therewith sufficient to support the frame assembly 10 and to support a tarp or covering thereover (not shown for clarity) during a storage season of the boat.

Thus what has been shown is a unique arrangement of components for simple and rapid attachment to a set of existing members typically found on a boat, which components permit adjustable fabrication of a frame assembly which may be customized to any size boat or similar structure. The components are adaptable and slidable relative to one another to permit secure properly sized construction of those components in a repeatable and reusable manner and adaptable to unique features of any particular boat. Those components, typically made of plastic or the like are also therefore weatherproof and lightweight.

I claim:

1. A customizable frame assembly for providing a housing structure for attachment to a boat rail arrangement on the gunnel of a boat, said assembly utilized for supporting a covering of said boat, said assembly comprising:

an arrangement of hollow elongated members connected by a plurality of articulable joints, said arrangement including a first hollow elongated member and a second hollow elongated member, each having a first end with a boat rail arrangement engaging portion thereon, wherein said boat rail engaging portion of said second elongated hollow member comprises a pair of elongated, spaced-apart leg portions having an elongated gap therebetween, and wherein said elongated gap has a tapered distal edge on each of said spaced-apart leg portions to facilitate attachment of said hollow, elongated member to a cable on said boat rail arrangement.

2. The customizable frame assembly as recited in claim 1, wherein said boat rail engaging portion of said first hollow elongated member comprises a resilient curved skirt flared over at least a portion of said first end of first hollow elongated member.

3. The customizable frame assembly as recited in claim 2, wherein said curved skirt portion has a narrowed pinched portion connecting said skirt portion to said hollow elongated member.

4. The customizable frame assembly as recited in claim 3, including a lower jaw portion arranged circumferentially opposed to said skirt portion, said lower jaw portion and said narrow pinched portion of said elongated member defining a boat rail arrangement engaging opening, said opening extending transverse to a longitudinal axis of said hollow elongated member.

5. The customizable frame assembly as recited in claim 4, wherein said lower jaw portion has a distal edge with a pair of formed apexes thereon to facilitate the engagement of said elongated hollow member onto a boat rail arrangement.

6. The customizable frame assembly as recited in claim 4, wherein said skirt has a distalmost lip which extends across said longitudinal axis of said elongated member.

7. The customizable frame assembly as recited in claim 1, wherein said spaced-apart leg portions are generally identical to one another.

8. A customizable frame assembly for providing a housing structure for attachment to a boat rail arrangement on the gunnel of a boat, said assembly utilized for supporting a covering of said boat, said assembly comprising:

an arrangement of hollow elongated members connected by a plurality of articulable joints, said arrangement including a first hollow elongated member and a second hollow elongated member, each having a first end with a boat rail arrangement engaging portion thereon, wherein said boat rail engaging portion of said first hollow elongated member comprises a resilient curved skirt flared over at least a portion of said first end of first hollow elongated member, wherein said boat rail engaging portion of said second elongated hollow member comprises a pair of elongated, spaced-apart leg portions having an elongated gap therebetween and wherein said elongated gap has a tapered distal edge on each of said spaced-apart leg portions to facilitate attachment of said hollow, elongated member to a cable on said boat rail arrangement.

* * * * *